United States Patent [19]

Meisel, Jr. et al.

[11] Patent Number: 4,606,694

[45] Date of Patent: Aug. 19, 1986

[54] LOAD SKIDDING VEHICLE

[75] Inventors: Thomas C. Meisel, Jr.; Lyle E. York, both of Peoria, Ill.

[73] Assignee: Caterpillar Inc., Peoria, Ill.

[21] Appl. No.: 455,766

[22] Filed: Jan. 5, 1983

Related U.S. Application Data

[63] Continuation of Ser. No. 258,504, Apr. 29, 1981, abandoned.

[51] Int. Cl.[4] ..... B66C 3/16

[52] U.S. Cl. ..... 414/732; 414/917; 414/569; 144/3 D

[58] Field of Search ..... 414/699, 729, 730–733, 414/735, 738, 739, 786, 917, 569; 144/3 D, 309 AC

[56] References Cited

U.S. PATENT DOCUMENTS

| | | | |
|---|---|---|---|
| 2,903,294 | 9/1959 | Shook . | |
| 3,034,821 | 5/1962 | Hacket et al. . | |
| 3,263,834 | 8/1966 | LaTendressee . | |
| 3,549,031 | 12/1970 | Blood et al. . | |
| 3,631,995 | 1/1972 | Jones et al. . | |
| 3,746,193 | 7/1973 | Eaves | 414/569 |
| 3,767,075 | 10/1973 | Levekenz et al. . | |
| 3,782,567 | 1/1974 | Likas et al. | 214/77 |
| 3,858,735 | 1/1975 | Zrostlick . | |
| 3,952,890 | 4/1976 | Armstrong . | |
| 4,005,894 | 2/1977 | Tucek . | |
| 4,140,233 | 2/1979 | Muntjanoff | 414/731 |
| 4,217,076 | 8/1970 | Robnett et al. | 414/735 |

FOREIGN PATENT DOCUMENTS 329571 12/1970 Sweden .

*Primary Examiner*—Terrance L. Siemens
*Attorney, Agent, or Firm*—J. W. Keen

[57] ABSTRACT

Load skidding vehicles commonly include a grapple assembly (42) which under load conditions can pivot rearwardly about its support point (52) resulting in disproportionate loading of the rear wheels and consequently instability of the vehicle. A connecting member (62) is pivotally attached between the grapple (42) and a hydraulic cylinder (74) which is attached to the skidder (2). Operation of the hydraulic cylinder (74) causes the grapple (42) to rotate about its support pivot (52). The hydraulic cylinder (74) may be locked causing the grapple (42) to be locked in relation to the boom assembly (26). During load hauling operations this mechanism is used to lock the load in a position near the vehicle resulting in increased stability. The mechanism is also of use in positioning the grapple assembly (42) with respect to the load prior to grasping it.

17 Claims, 8 Drawing Figures

LOAD SKIDDING VEHICLE

CROSS REFERENCE

This application is a continuation of U.S. application Ser. No. 258,504 filed Apr. 29, 1981, now abandoned, which was a continuation-in-part of currently pending PCT application Ser. No. PCT/US 80/01073 filed Aug. 20, 1980, U.S. application Ser. No. 250,742 now abandoned.

TECHNICAL FIELD

This invention relates to a load skidding vehicle of the type having a load engaging grapple, and more particularly to a mechanism for controllably positioning and releasably locking the grapple with respect to the vehicle in a number of operating positions.

BACKGROUND ART

In certain classes of hauling operations, such as moving harvested trees from their felling point to a collection point, there is often no feasible means of transporting a load other than by dragging it behind a vehicle. This is generally accomplished either by attaching the load to a load skidding vehicle with a cable or by grasping the load with a grapple suspended from an elevated support boom borne by the vehicle. Basic examples of grapple assemblies for use in load skidding applications are set forth in U.S. Pat. No. 3,620,394 which issued to Symons et al. on Nov. 16, 1971 and U.S. Pat. No. 3,513,998 which issued to Stone et al. on May 26, 1970.

The prime disadvantage of existing grapple skidders as opposed to cable skidders is that design strictures of the former necessitate that the grapple be pivotally connected to its support boom at a pivot point substantially above and behind the rear axle of the skidder. This results in the load being borne by the vehicle at this pivot point, this being the first point through which the load passes which is also rigidly connected to the skidding vehicle. This loading imposed upon the skidding vehicle may be described by a load vector having essentially two components both of which pass through the support boom-grapple pivot point. The first, rearwardly directed from and parallel to the longitudinal axis of the skidding vehicle, is the force required to overcome friction between the load and the ground across which it is skidded. The second, vertical and downwardly directed, is that portion of the weight of the load borne by the grapple.

As this load vector passes through a rearwardly extended elevated position, a substantial overturning moment exists about the rearmost ground contacting point of a loaded skidding vehicle. Consequently, current grapple skidders lose maneuverability when skidding a load. For those grapple skidders including a plurality of axles, the rearmost axle will suffer disproportionately great loading. Moreover, aside from the reduction in maneuverability there is a relatively low limit on the size of the load that can be carried with a grapple skidder. In some instances a load easily handled by a cable skidder will, if attempted with a grapple skidder of equivalent power, lift the front of the grapple skidder from the ground.

Efforts have previously been made toward the solution of these problems. One scheme involves the use of a force applying arm attached to the vehicle for applying a downward force on the load at a point rearwardly located from the grapple. Activating the arm provides a reactive force tending to equalize the weight distribution on the axles of the vehicle. This development is disclosed in U.S. Pat. No. 4,140,233 which issued to Muntjanoff et al. on Feb. 20, 1979.

Another manner of mitigating the problems detailed above involves fastening a cable from the boom supported grapple to the vehicle such that the cable may be placed in tension under load conditions and made slack under no load conditions. This results in the load being primarily carried by the cable thereby lowering the load vector and consequently decreasing the distance or moment arm from the rearmost point of skidder-ground contact to the load vector. Decreasing the moment arm decreases the overturning moment resulting in increased stability. This scheme is described in U.S. Pat. No. 3,746,193 which issued to Eaves on July 17, 1973. Among the disadvantages of this advance are the need to include a winch on the skidding vehicle and the difficulties presented in achieving free rotation of the grapple about its vertical axis owing to the attached cable.

Another problem that is common in conventional grapple type load skidding vehicles is that they permit free swinging movement of the grapple when the vehicle is travelling without a load. This movement of the grapple about its pivot point is often severe enough that the grapple comes in contact with some portion of the vehicle, occasionally resulting in damage. A means of preventing this involves snubbing the grapple to the back of the skidding vehicle by means of a cable and winch assembly. Such a scheme is set forth in U.S. Pat. No. 3,907,137 issued to Korbel et al. on Sept. 23, 1975. The significant disadvantages of this development are the necessity for a winch and a potentially obstructing cable.

Primary objectives for the design of conventional grapple type log skidding vehicles include minimizing the weight of the grapple and its supporting structure so as to maximize the vehicle's log payload and minimizing the height above the ground for the grapple and its supporting structure's center of gravity so as to maximize the skidder's stability for the positions assumable by such grapple and supporting structure. A further objective is to minimize the number of pin joints due to their expense and service requirements. U.S. Pat. No. 4,005,894 which issued Feb. 1, 1977, illustrates a log loader apparatus which includes a manipulatable, multiboom grapple. The fluid ram for manipulating the lower boom is Joined at one end to the loader's turntable and the fluid ram for manipulating the upper boom is joined at one end to the lower boom. Such elevated disposition of the rams contribute to the vehicle's instability.

Such log loader is stationary during operation of its turntable and multiple booms and thus permits use of the illustrated outriggers to provide stability for it. Moreover, the fluid ram connected between the booms exerts bending stresses on the lower boom during operation which either decreases the life of that boom or necessitates the use of a heavier lower boom which results in a commensurately smaller workload.

In addition to the characteristics of reduced stability and smaller payload such apparatus would contribute to a skidder vehicle, a further disadvantage of such elevated boom manipulating fluid rams is the additional length of fluid lines needed as well as the extra shielding and associated weight of same required to protect the lines from hazards which are commonplace in a woods environment. Additionally, the extra pin joints and associated linkage between the grapple and elevated grapple tilting cylinder increase the apparatus' expense, further reduce its stability, and decrease the reliability of the utilizing vehicle.

The present invention is directed to overcoming one or more of the problems as set forth above.

DISCLOSURE OF THE INVENTION

In one aspect of the present invention a load skidding vehicle is provided with a boom pivotally mounted thereon and a load grasping device rotatably and pivotally connected to the boom. There is also provided a mechanism for releasably locking and controllably positioning the grasping device with respect to the boom such that the grasping device may be controllably rotated or locked against movement in a direction aligned with the longitudinal axis of the vehicle.

BEST MODE FOR CARRYING OUT THE INVENTION

Figure 7:
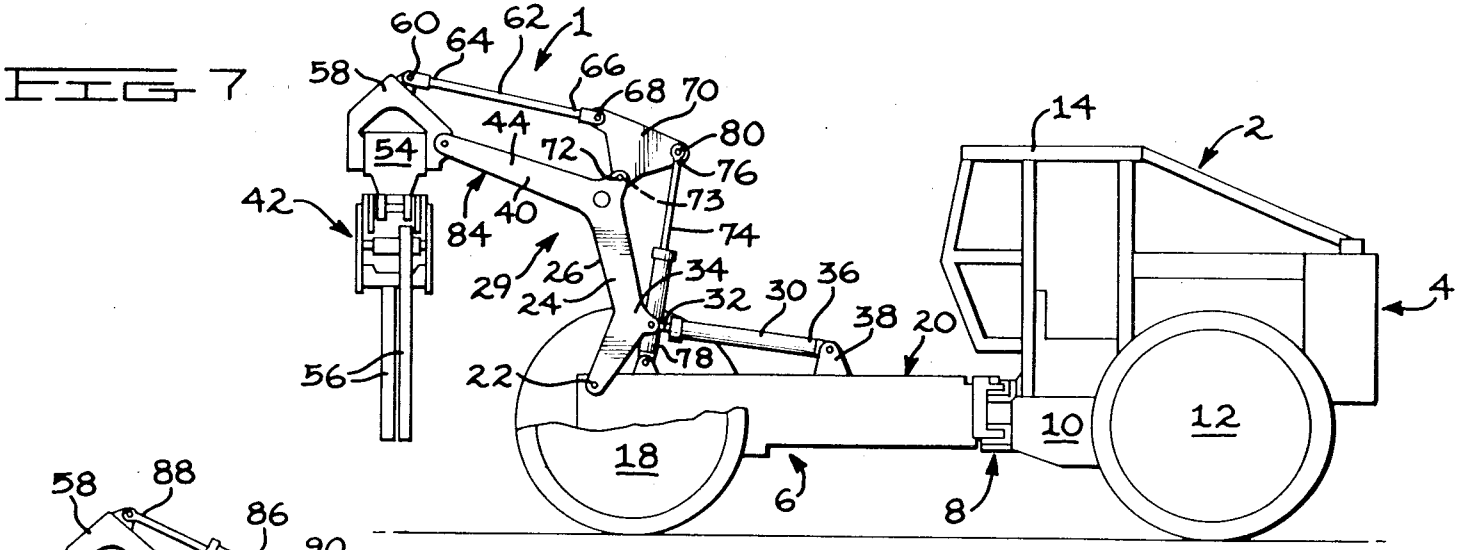
FIG. 7 is a side view of a load skidding vehicle having a load control mechanism embodying the present invention mounted on an A-frame type grapple support assembly.

Referring to FIG. 7, a load control mechanism embodying the principle of the present invention is generally indicated by the reference numeral 1 and is mounted on a load skidding vehicle 2 commonly known as a "log skidder". The skidder 2 is articulated, having a front end 4 and a rear end 6 joined by a multiple axis pivotal connection 8. The front end 4 has a chassis 10 and mounted thereon are a wheel assembly 12, power providing means (not shown) and an operator's station 14 containing controls (not shown) for operating the skidding vehicle 2.

The rear end 6 has a chassis 16 which is mounted on a wheel assembly 18 and includes a mounting frame 20. Mounted on the mounting frame 20 is a support assembly such as grapple support assembly 29 which is preferably of the "A-frame" type as shown in FIG. 7. Alternatively, as shown in FIGS. 1-6, a "parallelogram" type grapple support assembly 29 may be used. These differ from one another in a manner well known by those skilled in the art. Vehicles 2 incorporating each of these types of grapple support assemblies 29 will be discussed concurrently, as they are very similar. Where there are differences, these differences will be noted.

The grapple support assembly 29 is attached by twin pivotal connections 22 to the rear of mounting frame 20. This support assembly 29 includes a U-shaped arch 24 having two arch legs 26 and a crossmember 28 (not shown on FIG. 7) connecting these legs 26. The arch 24 is the main support for a boom assembly 84. Each arch leg 26 ends at its respective pivotal connection 22. An arch cylinder 30 is pivotally attached at a first end 32 to an intermediate point 34 of each arch leg 26. A second end 36 of each arch cylinder 30 is pivotally connected to one of two forward points 38 on the mounting frame 20, so located that the arch cylinders 30 are substantially parallel. The extension of the arch cylinders 30 may be controllably increased or decreased by means well known in the art so as to cause the arch 24 to pivot about its twin pivotal connections 22.

In the "parallelogram"-type grapple support assembly 29, a boom 40 is pivotally connected along a pivotal axis 41 to the crossmember 28 of the arch 24. In the "A-frame" type grapple support assembly 29, the boom 40 is rigidly attached to the crossmember 28. The boom 40 extends rearwardly from the arch 24 for supporting a grasping device such as grapple assembly 42 and includes two boom arms 44 which extend rearwardly from the arch 24.

In the parallelogram type grapple support assembly 29, a pair of boom cylinders 46, each having a first end 48 and a second end 50, are pivotally connected by their first ends 48 to the boom 40 and by their second ends 50 to the mounting frame 20 such that the two boom cylinders 46 are substantially parallel. The length of the boom cylinders 46 may be controllably increased or decreased by means well known in the art so as to cause the boom 40 to pivot about its connection on the crossmember 28.

Pivotally attached at a rear pivot point 52 on the aftmost portion of the boom 40 is the grapple assembly 42. The grapple assembly 42 includes a rotator 54 for rotatably positioning the grapple assembly 42, grapple arms 56 depending from the rotator 54 for grasping loads, a vertical extender 58 attached to the rotator 54, and means (not shown) for controllably opening and closing the grapple arms 56. The rear pivot point 52 passes through the vertical extender 58.

The vertical extender 58 is pivotally attached to the uppermost portion of the grapple assembly 42 so as to allow the grapple assembly 42 to rotate with respect to the vertical extender 58 along an axis parallel to the longitudinal axis of the load skidding vehicle 2. A pivot point 60 for a connecting member 62 is located on the vertical extender 58 a distance above the rear pivot point 52. This distance must be sufficiently great as to allow the force applied through the connecting member 62 to create a moment about the rear pivot point 52 sufficient to counter the opposite moment induced by a skidded load without allowing appreciable pivotal movement of the grapple 42 about the rear pivot point 52.

The connecting member 62 is connected at a first end 64 to pivot point 60 and at a second end 66 to a pivot point 68. Connecting member 62 must be of sufficient rigidity to withstand the compressive loading necessary to counter the moment of the load vector. It is additionally beneficial to orient pivot points 60 and 68 with respect to the rear pivot point 52 and the arch 24-boom 40 connection such that these four points approximately define the corners of a parallelogram.

At pivot point 68 the connecting member 62 is attached to an upper aft portion of an equalizing link 70. The equalizing link 70 has a lower central point 73 at which it is connected to an upper central point 72 of the crossmember 28. A hydraulic control cylinder 74, having a first end 76 and a second end 78, is pivotally connected by its first end 76 to a central forward point 80 on the equalizing link 70. The equalizing link 70 has the function of rigidly maintaining the distances between the pivots at 68,72 and 80 such that with the arch 24 locked in position (and consequently point 72 is locked since point 72 is fixedly attached to arch 24) a force may be transmitted from the control cylinder 74 to the connecting member 62.

The control cylinder 74 is pivotally attached at its second end 78 to the mounting frame 20 so that it lies in a vertical plane passing through the longitudinal axis of the load skidding vehicle 2. Means (not shown) well known in the art is provided for operating the control cylinder 74 such that the distance from the first end 76 of the control cylinder 74 to the second end 78 may be increased, decreased, maintained at a set length or permitted to float (that is, to vary with minimal resistance). Like means is included for controlling the boom cylinders 46 and the arch cylinders 30.

Figure 8:
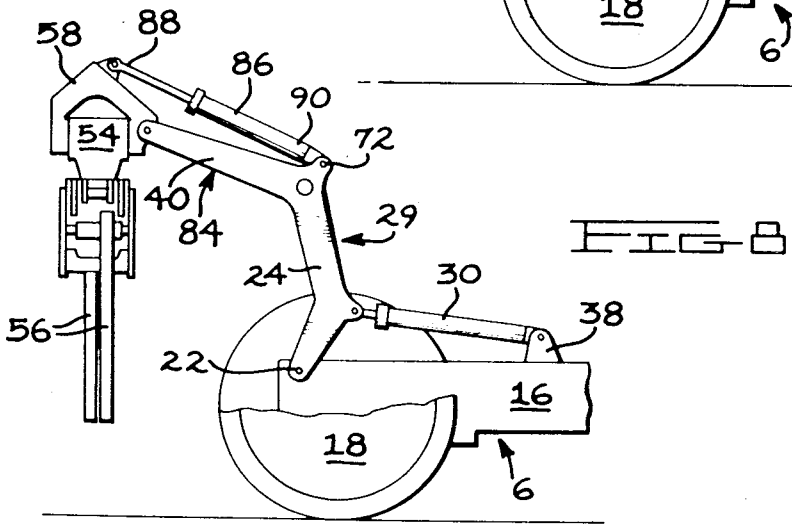
FIG. 8 is a side view of an additional embodiment of the present invention shown mounted on an A-frame type grapple support assembly.

It is apparent from the above described embodiments that the present invention could also comprise a fluid jack 86 connected intermediate the vertical extender 58 and the grapple support assembly 29. Such an embodiment is shown in FIG. 8. The fluid jack 82 has first and second ends 88,90, and is connected by the first end 88 to the vertical extender 58 and by the second end 90 to the upper central point 72 of the crossmember 28.

INDUSTRIAL APPLICABILITY

The present invention provides a solution to the difficulties inherent to load skidding vehicles with freely pivotable load engaging means. The present invention provides means for permitting the grasping device-boom 40 combination, for the purposes of skidding operations, to be made equivalent to a single rigid member. The load vector will then pass through a point lower than the rear pivot point 52 resulting in a smaller moment about the rear wheel assembly 18 consequently yielding a more even distribution of the load between the axles of the load skidding vehicle 2.

In the preferred embodiment of this invention selective immobilization of the grapple 42 with respect to the boom 40 is achieved by fixing in relation to the work vehicle 2 two separated points 52,60 on the grapple assembly 42. While fixing the location of but a single pivot will not prevent rotation about that pivot, fixing the locations of two non-colinear pivots will prevent rotation about either pivot.

Figure 1:
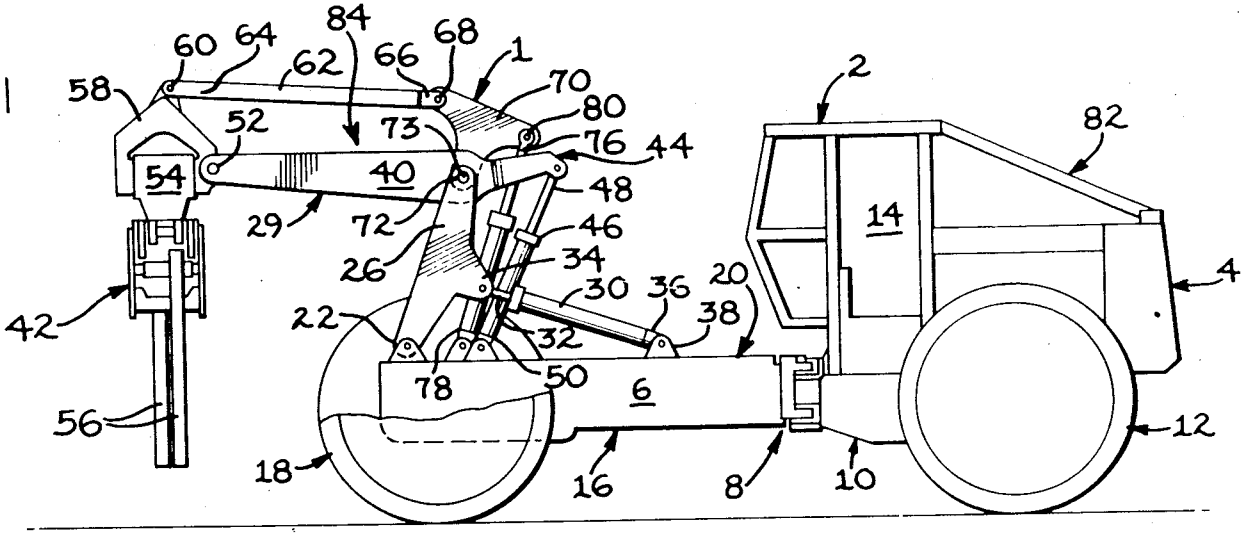
FIG. 1 is a side view of a load skidding vehicle showing a load control mechanism embodying the present invention mounted on a parallelogram type grapple support assembly.
Figure 2:
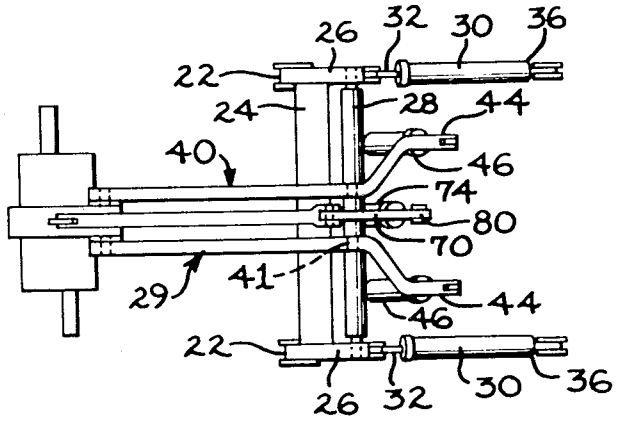
FIG. 2 is a partial top view of the load skidding vehicle and load control mechanism corresponding to FIG. 1.

The means 62,70,74 for immobilizing the grapple assembly 42 can assume embodiments other than that considered the best mode. For example, the grapple-boom connection 52 could be a pin-type pivot (as shown in FIGS. 1 and 2) with means added for selectively increasing the friction between the pin and the two members connected to it to the point where no rotation is possible under the loadings anticipated.

Figure 3:
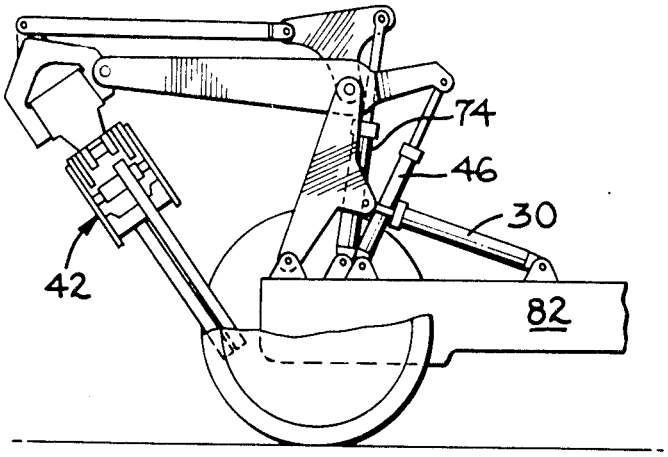
FIG. 3 is a partial side view of a load skidding vehicle with a load control mechanism showing forward rotation of a grapple owing to extension of the control cylinder.
Figure 4:
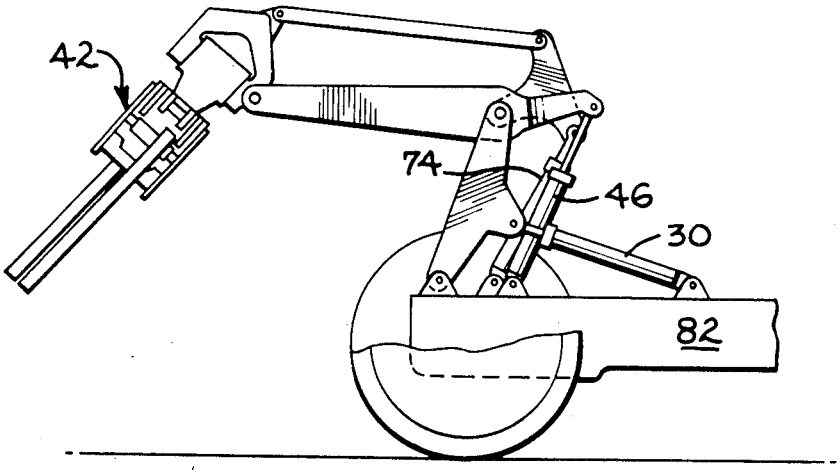
FIG. 4 is a partial side view of a load skidding vehicle with a load control mechanism showing rearward rotation of the grapple owing to retraction of the control cylinder.

Operation of the load control mechanism 1 that constitutes the advance of this load skidding vehicle 2 over existing designs is achieved through operation of the control cylinder 74. Controllable rotation of the grapple assembly 42 about its rear pivot point 52 is obtained by increasing or decreasing the length of the control cylinder 74. This causes the central forward pivot point 80, directly attached to the control cylinder 74, to move, respectively, away from or toward the mounting frame 20. This serves to rotate the equalizing link 70 about the pivot point 68 respectively toward or away from the grapple assembly 42. This forces the connecting member 62 to move rearwardly or forwardly, respectively, resulting in rotation of the grapple assembly 42 about the rear pivot 52 toward or away from the skidder 2, respectively. FIG. 3 illustrates the grapple assembly 42 in a forwardly rotated position resulting from extending the control cylinder 74. FIG. 4 illustrates the grapple 42 in a rearwardly rotated position resulting from retracting the control cylinder 74.

Once the grapple assembly 42 has been rotated to the desired angle it may be locked in position. With the boom assembly 26 locked (achieved by locking the arch cylinders 30 and also, for the parallelogram-type grapple support assembly 29, the boom cylinders 46), locking the control cylinder 74 results in fixing the position of the equalizing link 70 with respect to the load skidding vehicle 2. This immobilizes the position of the pivot point 68 thereby locking the position of the connecting member 62. Once this is done, the locations with reference to the load skidding vehicle 2 of the pivot points 60 and 52 are fixed and consequently the grapple assembly 42 is not free to rotate.

The broad positional flexibility of the grapple assembly 42 is a major feature of the present invention. This is achieved through the combination of the controllable rotation of the grapple assembly 42 about the rear pivot point 52, detailed above, with the up and down fore and aft positioning capabilities of the parallelogram-type grapple support assembly 29, the latter being well known in the art. Fore and aft movement of the grapple assembly 42 is achieved through control of the arch cylinders 30; extending the arch cylinders 30 causes movement of the grapple assembly away from the vehicle 2, while retracting the arch cylinder 30 will result in movement toward the vehicle 2. In the parallelogram-type grapple support assembly 29, the elevation of the grapple assembly 42 is altered through control of the boom cylinders 46. Retraction of the boom cylinders 46 will raise the grapple assembly 42 while extension of the boom cylinders 46 will lower it.

Connection of the boom-arch manipulating cylinders 30 and 46 directly to the vehicle chassis 16 lowers the the composite center of gravity and improves the vehicle's stability over that obtained from elevated manipulating cylinders connected between the boom 40 and arch 24 or between the boom 40 or arch 24 and an elevated structure such as a turntable (not shown).

Disposition of the grapple tilting cylinder 86 at the elevated position illustrated in FIG. 8 or at the chassis-mounted position of FIGS. 1 and 7 is chosen by comparing the relative weights, relative locations of the center of gravity, relative costs, and anticipated reliability of the cylinder 74 - linkage 62,70 configuration of FIGS. 1 and 7 versus the cylinder 86 configuration of FIG. 8. While the manipulating cylinders 30 and 46, from an analysis of a skidder vehicle's stability, cost, and reliability, are preferably connected to the chassis 16 for skidder applications, the grapple tilting cylinders 74,86 may be disposed in either of the configurations hereinbefore described depending upon the results of the comparison also hereinbefore described.

Figure 5:
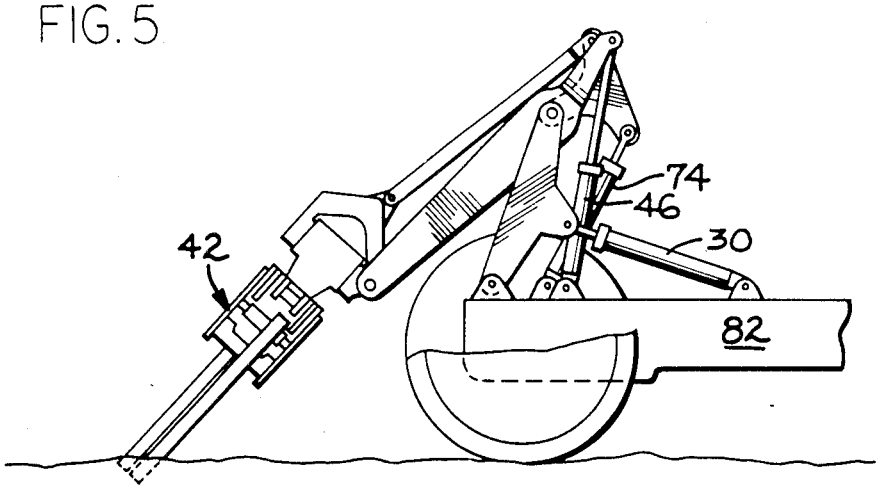
FIG. 5 is a partial side view of the load skidding vehicle of FIG. 4 showing downward movement of the grapple due to the extension of boom cylinder 46.
Figure 6:
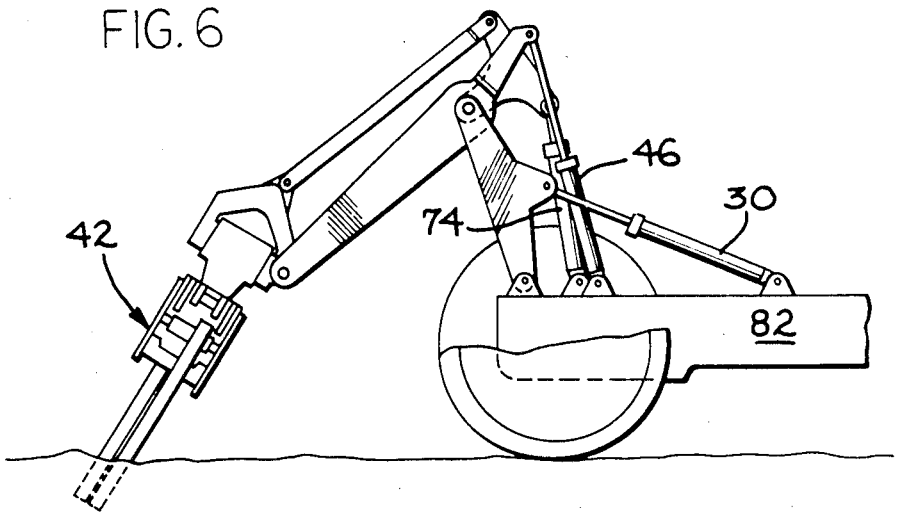
FIG. 6 is a partial side view of the load skidding vehicle of FIG. 5 showing rearward movement of the grapple due to the extension of arch cylinder 30.

A description of the use of the grapple assembly 42 and grapple support assembly 29 to free the vehicle 2 when mired in mud will serve to illustrate the positional capabilities of the present invention. The following description is applicable to the parallelogram-type grapple support assembly 29. Consider the initial grapple assembly 42-work vehicle 2 orientation shown in FIG. 3, a forwardly rotated upper forward position. This is achieved by retracting both the arch cylinder 30 and the boom cylinders 46 while extending the control cylinder 74. From this position, the grapple assembly 42 is rotated away from the vehicle 2 by retracting the control cylinder 74 as illustrated in FIG. 4. Next, the boom cylinders 46 are extended until the grapple assembly 42 is pressed firmly into the mud as shown in FIG. 5. Lastly, using the locked grapple assembly 42 as an anchored point the arch cylinders 30 are extended forcing the grapple assembly 42 to move rearwards with respect to the work vehicle 2, or, as is reality, the work vehicle 2 to move forward in relation to the anchored grapple assembly 42. The result is shown in FIG. 6.

The prime advantage of this invention is the improvement it imparts to the load handling characteristics of a load skidding vehicle. This improvement is achieved by grasping the load with the grapple assembly 42, positioning it as near the rear of the vehicle as possible, and locking the grapple assembly 42 in this position. This positioning may be achieved in one of two ways: if the load is sufficiently light the control cylinder 74 and connecting member assembly 62,58,70 may be used to rotate the grapple and its load toward the rear of the vehicle; or, with heavier loads, the load control mechanism 1 may be placed in float and the vehicle 2 then backed toward the load until the position of the grapple assembly 42 is as desired at which point the grapple assembly 42 is locked.

A summary of the advantages of the invention detailed in this application over conventional skidders are as follows:

(1) For given loading there is improved maneuverability.

(2) The skidder is capable of handling a greater total load.

(3) When travelling in a no load situation the grapple can be locked to prevent it from swinging along the direction of the longitudinal axis of the skidder.

(4) When the skidder becomes stuck in swampy or muddy areas the grapple assembly can be locked, lowered to the ground and used to push the vehicle forward.

(5) In the preferred embodiment of this invention the vertical axis of the grapple can be controllably rotated about the grapple-boom pivot point in the vertical plane passing through the longitudinal axis of the vehicle thereby providing for greater positional flexibility.

(6) The load control mechanism 1 when embodied as the parallelogram linkage described previously maintains an essentially constant grapple orientation so long as the control cylinder 74 is of constant extension.

The invention herein described is not limited to use with parallelogram-type and A-frame type boom assemblies such as those illustrated, but is equally applicable to other types of boom assemblies.

It should be understood that the load skidding vehicle can assume many other configurations without departing from the claims. Other aspects, objects and advantages of this invention can be obtained from a study of the drawings, the disclosure and the appended claims.

We claim:

1. A log skidding vehicle (2), comprising:

a chassis (16) having a forward and a rearward end;

a support assembly (29) mounted on and extending rearwardly from said chassis (16);

log engaging means (42) for holding one portion of a log above the ground with another portion of the log remaining in contact with the ground during forward movement of said chassis (16), said log engaging means (42) being pivotally connected to said support assembly (29) about a substantially horizontal axis and being freely laterally pivotable about an axis parallel to the longitudinal axis of the chassis (16); and means (62,70,74,86) for controllably pivoting said log engaging means (42) about said substantially horizontal axis both toward and away from said chassis (16).

2. A skidder vehicle (2) for lifting one portion of a log and dragging another portion of the log, said skidder vehicle (20) comprising:

a chassis (16);

a support assembly (29) mounted on and extending from said chassis (16);

log engaging means (42) for grasping said one log portion, said log engaging means (42) being pivotably attached to said support assembly (29) about a pivot axis (52) and being freely laterally pivotable about a swivel axis parallel to the vehicle's longitudinal axis;

at least one hydraulic manipulating cylinder (30,46) for selectively positioning said support assembly (29) relative to said chassis (16), said one manipulating cylinder (30,46) being directly connected at one end (36,50) to said chassis (16) and at the other end (32,48) to said support assembly (29); and means (62,70,74,86) for pivotally positioning said log engaging means (42) to any pivotal location about said pivot axis (52) relative to said support assembly (29).

3. The skidder vehicle (2) of claim 2 having a front end (4) and a rear end (6) wherein said support assembly (29) is connected to and projects rearwardly from said rear end (6).

4. The skidder vehicle (2) of claim 2 wherein said pivot axis (52) is substantially horizontal and perpendicular to the longitudinal axis of the vehicle (2).

5. The skidder vehicle (2) of claim 2 wherein said log engaging means (42) includes a grapple (42).

6. The skidder vehicle (2) of claim 2 wherein said pivotal positioning means (62,70,74,86) further includes a connecting member (62) having opposite ends (64,66) pivotally attached at a first end (64) to said log engaging means (42), and means (70,74) for displacing a second end (66) of said connecting member (62) with respect to said chassis (16).

7. The skidder vehicle (2) of claim 5 wherein said displacing means (70,74) includes a fluid motor (74) having a first end (76) and a second end (78) pivotally attached to said chassis (16).

8. The skidder vehicle (2) of claim 7 wherein said displacing means (70,74) includes an equalizing link (70) pivotally attached to said connecting member (62) and separately pivotally attached both to said first end (76) of said fluid motor (74) and to said support assembly (29).

9. The skidder vehicle (2) of claim 6 including a vertical extender (58) for pivotally connecting said connecting member (62) to said log engaging means (42) at a pivot point (60), said extender (58) being laterally pivotably attached to said log engaging means (42) such that said pivot point (60) is spaced a vertical distance above said pivot axis (52).

10. The skidder vehicle (2) of claim 2 wherein said pivotal positioning means (62,70,74,86) includes a controllable fluid cylinder (86) having a first end (90) and a second end (88), said first end (90) being connected to said log engaging means (42) and said second end (88) being connected to said support assembly (29).

11. The skidder vehicle (2) of claim 2 wherein all of said manipulating cylinders (30,46) are connected at one end (36,50) to said chassis (16) and at the other end (32,48) to said support assembly (29).

12. A skidder vehicle (2), comprising:

a chassis (16);

an arch (24) pivotally connected to said chassis (16);

at least one arch manipulating cylinder (30) pivotally mounted at a first end (32) to said arch (24) and at a second end (36) to said chassis (16);

a grapple assembly (42) pivotally connected to said arch (24) about a pivot axis (52) perpendicular to the chassis' longitudinal axis and being freely laterally pivotable about an axis parallel to the chassis' longitudinal axis; and means (86) connected at one end (88) to said grapple assembly (42) and connected at a second end (90) to said arch (24) for pivotally positioning said grapple assembly (42) at any location about said pivot axis (52).

13. The skidder vehicle (2) of claim 12 wherein said pivotal positioning means (86) is directly connected to said grapple assembly (42).

14. In a skidding vehicle (2) having a chassis (16), a support assembly (29) mounted on and extending from said chassis (16), and log engaging means (42) for grasping a log being pivotally connected to said support assembly (29) about a pivot axis (52) perpendicular to the chassis' longitudinal axis and being freely laterally pivotable about an axis parallel to the chassis' longitudinal axis, the improvement comprising:

means (74,86) for pivoting said log engaging means (42) to any desired pivotal position about said pivot axis (52).

15. A method for transporting a log with log engaging means (42) which is pivotally connected about a pivot axis (52) to a support assembly (29) extending rearwardly from and being pivotally mounted to a vehicle chassis (16) which constitutes a portion of a vehicle (2), said method comprising:

pivoting the log engaging means (42) about the pivot axis (52) to any desired position to facilitate alignment thereof with the log;

grasping the log with said log engaging means (42);

actuating at least one hydraulic manipulating cylinder (30,46) to elevate one end of the log above the ground with said log engaging means (42) while permitting the other end of the log to rest on the ground;

pivoting the log engaging means (42) and the grasped log in either direction toward or away from the chassis (16) about the pivot axis (52) to a desired arcuate position;

permitting free lateral pivoting of the log engaging means (42) about an axis parallel to the chassis' longitudinal axis; and moving said vehicle chassis (16) in a forwardly direction.

16. The method of claim 15, said pivoting comprising:

supplying pressurized fluid to a fluid jack (74,86) one end (76,88) of which is connected to the log engaging means (42) to pivot the log engaging means (42) in the desired direction.

17. The method of claim 15 wherein said vehicle (2) has a rear (18) and a front (12) ground engaging portion respectively disposed adjacent and remote from said log engaging means (42), said log engaging means (42) being pivoted in the direction which maintains engagement between the ground and all the ground engaging portions (12,18) during movement of the vehicle chassis (16).

* * * * *

UNITED STATES PATENT AND TRADEMARK OFFICE

CERTIFICATE OF CORRECTION

PATENT NO. : 4,606,694

DATED : August 19, 1986

INVENTOR(S) : Thomas C. Meisel, Jr. et al

It is certified that error appears in the above-identified patent and that said Letters Patent are hereby corrected as shown below:

Column 8, line 62: delete "5" and insert --6--.

Signed and Sealed this

Eighteenth Day of November, 1986

*Attest:*

DONALD J. QUIGG

*Attesting Officer* *Commissioner of Patents and Trademarks*